US011014140B2

(12) United States Patent
Banks et al.

(10) Patent No.: US 11,014,140 B2
(45) Date of Patent: May 25, 2021

(54) CERAMIC CORE SETTER

(71) Applicant: United Technologies Corporation, Farmington, CT (US)

(72) Inventors: Anton G. Banks, Manchester, CT (US); Lea Dynnette Castle, Vernon, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 58 days.

(21) Appl. No.: 16/384,664

(22) Filed: Apr. 15, 2019

(65) Prior Publication Data

US 2020/0324333 A1 Oct. 15, 2020

(51) Int. Cl.

| | |
|---|---|
| ***B22C 9/10*** | (2006.01) |
| ***B21D 37/10*** | (2006.01) |
| ***B21D 37/14*** | (2006.01) |
| ***B22C 21/14*** | (2006.01) |

(52) U.S. Cl.

CPC ..... *B21D 37/10* (2013.01); *B21D 37/14* (2013.01); *B22C 9/10* (2013.01); *F05D 2230/21* (2013.01)

(58) Field of Classification Search

CPC ..... B22C 9/10; B22C 9/108; B22C 21/14; B22D 33/00; B22D 33/04; B21D 37/10; B21D 37/14; B28B 11/243; B28B 11/248; F05D 2230/21

USPC ..... 164/137, 339, 369, 397

See application file for complete search history.

(56) References Cited

U.S. PATENT DOCUMENTS

| | | | | |
|---|---|---|---|---|
| 5,891,384 | A * | 4/1999 | Miyajima | B29C 33/68 264/511 |
| 6,533,986 | B1 | 3/2003 | Fosaaen et al. | |
| 6,808,010 | B2 | 10/2004 | Dixon et al. | |
| 2009/0224441 | A1 | 9/2009 | Dodds | |
| 2010/0006215 | A1* | 1/2010 | Kawakubo et al. | B29C 43/021 156/245 |
| 2013/0220571 | A1* | 8/2013 | Mueller et al. | B22C 9/04 164/44 |
| 2017/0008809 | A1 | 1/2017 | Fribourg | |

OTHER PUBLICATIONS

European Search Report Application No. EP20169575; dated Sep. 7, 2020; pp. 10.

* cited by examiner

*Primary Examiner* — Kevin P Kerns
(74) *Attorney, Agent, or Firm* — Cantor Colburn LLP

(57) ABSTRACT

A die setting apparatus for a ceramic core is provided. The die setting apparatus includes a first setter abuttable with a first side of the ceramic core and a second setter abuttable with a second side of the ceramic core opposite the first side. At least one of the first and second setters includes two or more pieces respectively arranged to form one or more gaps. Each of the one or more gaps is oriented to thermally adjust in correspondence with thermal changes of the ceramic core during a firing process thereof.

17 Claims, 4 Drawing Sheets

CERAMIC CORE SETTER

BACKGROUND

Exemplary embodiments of the present disclosure relate generally to ceramic cores and, in one embodiment, to turbine airfoil ceramic cores.

Current turbine airfoil ceramic cores often have complex shapes. In some cases, they taper axially at the trailing edge, sometimes quite severely. A result of this is that their thicknesses vary greatly from leading edge to trailing edge. An additional concern relates to aerodynamic or structural requirements driving these same airfoils to be bowed in the tangential direction, which leads to a trailing edge form that is curved radially from a root of the airfoil to the tip. The large variation in thickness combined with a substantial bow can make the core difficult to produce.

In detail, ceramic cores are first produced in a mold. In a subsequent step in the process, the cores are placed between an upper and lower setter and fired. It is during this step that cores with large amounts of bow and drastic changes in thickness, as described above, become prone to breakage. Both the upper and lower setters are currently produced as one-piece items, respectively. The upper and lower setters typically have a different coefficient of thermal expansion than the ceramic cores that they are used to fire.

During processing, a ceramic core is sandwiched between an upper and lower setter to preserve dimensional accuracy. The setters are also disposed with enough of a gap to allow for movement of the ceramic core as some parts shift due to the thermal gradient of the part. These two requirements often contradict. That is, if the setter is too restrictive, the ceramic core will break but, if the setter is too loose, dimensional accuracy will be degraded.

BRIEF DESCRIPTION

According to an aspect of the disclosure, a die setting apparatus is provided for a ceramic core is provided. The die setting apparatus includes a first setter abuttable with a first side of the ceramic core and a second setter abuttable with a second side of the ceramic core opposite the first side. At least one of the first and second setters includes two or more pieces respectively arranged to form one or more gaps. Each of the one or more gaps is oriented to thermally adjust in correspondence with thermal changes of the ceramic core during a firing process thereof.

In accordance with additional or alternative embodiments, the ceramic core is provided to form a component of an aerodynamic element, the first and second setters include first and second surfaces, respectively, which are respectively abutable with respective substantial entireties of the first and second sides of the ceramic core, and the first and second surfaces have first and second curvatures which are respectively complementary to corresponding curvatures of the first and second sides of the ceramic core.

In accordance with additional or alternative embodiments, the die setting apparatus further includes a jig and bearing elements respectively interposed between the jig and the two or more pieces of the at least one of the first and second setters.

In accordance with additional or alternative embodiments, the die setting apparatus further includes at least one of a thermal expansion material disposable to drive a thermal expansion of one or more of the one or more gaps and a thermal contraction material disposable to drive a thermal contraction of one or more of the one or more gaps.

In accordance with additional or alternative embodiments, the at least one of the thermal expansion material and the thermal contraction material has a coefficient of thermal expansion (CTE) matched to that of the ceramic core.

In accordance with additional or alternative embodiments, the thermal expansion material is disposable within the one or more of the one or more gaps and the thermal contraction material is disposable at an exterior of the one or more of the one or more gaps.

In accordance with additional or alternative embodiments, the first setter includes two or more first setter pieces respectively arranged to form one or more first gaps, the second setter includes two or more second setter pieces respectively arranged to form one or more second gaps and each of the one or more first and second gaps is oriented to thermally adjust in correspondence with the thermal changes of the ceramic core during the firing process thereof.

In accordance with additional or alternative embodiments, a number of the two or more first setter pieces differs from a number of the two or more second setter pieces.

In accordance with additional or alternative embodiments, at least one of the first and second setters includes first setter material having a coefficient of thermal expansion (CTE) differing from that of the ceramic core and second setter material having a CTE matched to that of the ceramic core.

In accordance with additional or alternative embodiments, the second setter material is localized.

In accordance with additional or alternative embodiments, the second setter material is integral with the first setter material.

According to another aspect of the disclosure, a die setting apparatus for a ceramic core is provided. The die setting apparatus includes a first setter abuttable with a first side of the ceramic core and comprising two or more first setter pieces respectively arranged to form one or more first gaps and a second setter abuttable with a second side of the ceramic core opposite the first side and comprising two or more second setter pieces respectively arranged to form one or more second gaps. Each of the one or more first and second gaps is oriented to thermally expand or contract in correspondence with the thermal expansion or contraction of the ceramic core during a firing process thereof. The die setting apparatus further includes at least one of thermal expansion and contraction material disposable to drive a thermal expansion or contraction of one or more of the one or more first and second gaps.

In accordance with additional or alternative embodiments, the ceramic core is provided to form a component of an aerodynamic element, the first setter pieces of the first setter respectively include first setter piece surfaces which are respectively abutable with corresponding portions of a substantial entirety of the first side, the second setter pieces of the second setter respectively include second setter piece surfaces which are respectively abutable with corresponding portions of a substantial entirety of the second side and the first and second setter piece surfaces have first and second piece-wise curvatures which are respectively complementary to corresponding curvatures of the first and second sides.

In accordance with additional or alternative embodiments, the die setting apparatus further includes first and second jigs, first bearing elements respectively interposed between the first jig and the two or more first setter pieces of the first setter and second bearing elements respectively interposed between the second jig and the two or more second setter pieces of the second setter.

In accordance with additional or alternative embodiments, the at least one of the thermal expansion and contraction material has a coefficient of thermal expansion (CTE) matched to that of the ceramic core.

In accordance with additional or alternative embodiments, the thermal expansion material is disposable within the one or more of the one or more first and second gaps and the thermal contraction material is disposable at an exterior of the one or more of the one or more first and second gaps.

In accordance with additional or alternative embodiments, a number of the two or more first setter pieces differs from a number of the two or more second setter pieces.

According to another aspect of the disclosure, a die setting apparatus for a ceramic core is provided. The die setting apparatus includes a first setter abuttable with a first side of the ceramic core and a second setter abuttable with a second side of the ceramic core opposite the first side. At least one of the first and second setters includes first setter material having a coefficient of thermal expansion (CTE) differing from that of the ceramic core and second setter material having a CTE matched to that of the ceramic core.

In accordance with additional or alternative embodiments, the second setter material is localized.

In accordance with additional or alternative embodiments, the second setter material is integral with the first setter material.

These and other advantages and features will become more apparent from the following description taken in conjunction with the drawings.

BRIEF DESCRIPTION OF THE DRAWINGS

The following descriptions should not be considered limiting in any way. With reference to the accompanying drawings, like elements are numbered alike.

These and other advantages and features will become more apparent from the following description taken in conjunction with the drawings.

DETAILED DESCRIPTION

A detailed description of one or more embodiments of the disclosed apparatus and method are presented herein by way of exemplification and not limitation with reference to the Figures.

Figure 1:
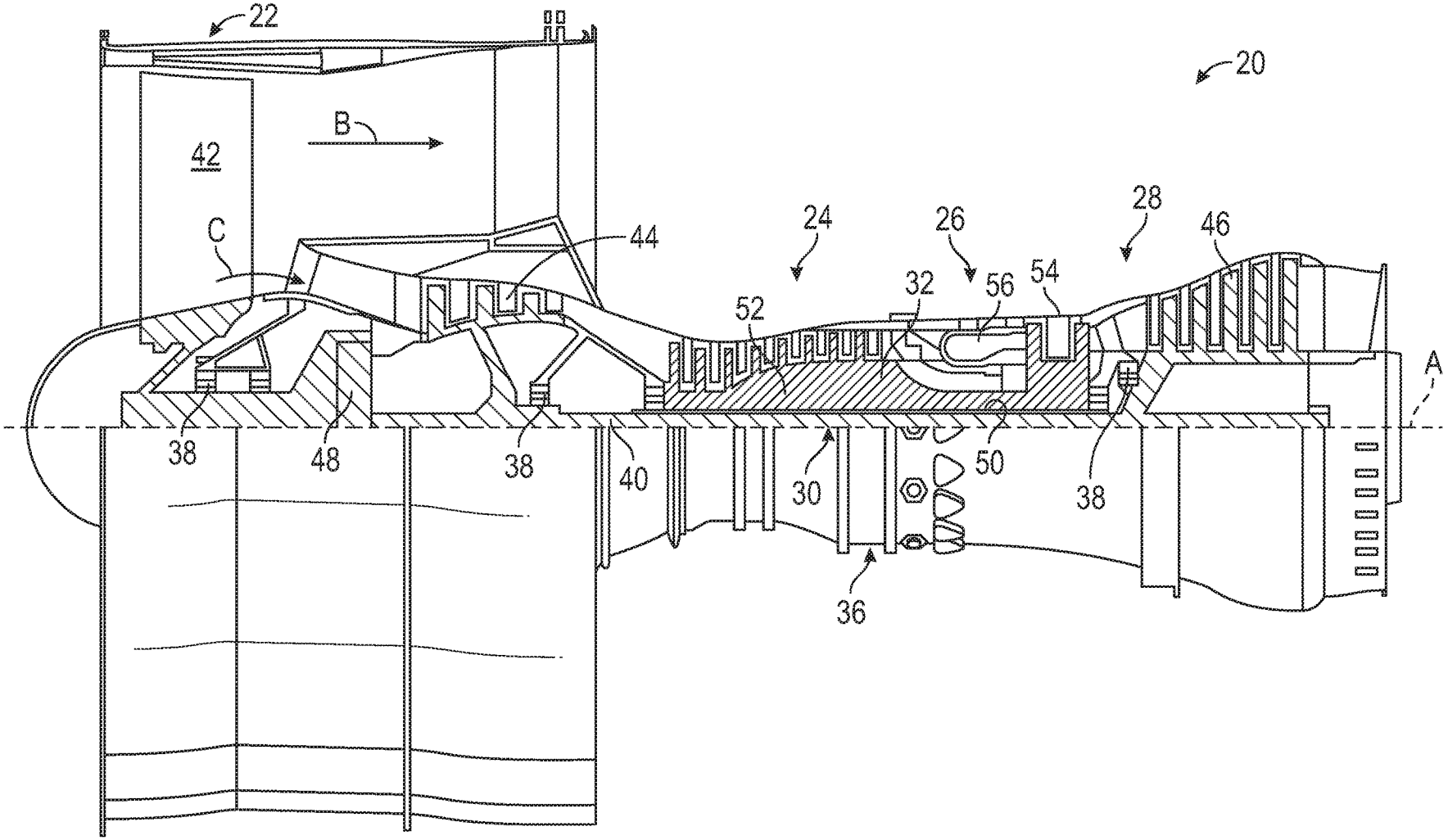
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 and then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary gas turbine engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in the gas turbine engine 20 between the high pressure compressor 52 and the high pressure turbine 54. The engine static structure 36 is arranged generally between the high pressure turbine 54 and the low pressure turbine 46. The engine static structure 36 further supports the bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 and then the high pressure compressor 52, is mixed and burned with fuel in the combustor 56 and is then expanded over the high pressure turbine 54 and the low pressure turbine 46. The high and low pressure turbines 54 and 46 rotationally drive the low speed spool 30 and the high speed spool 32, respectively, in response to the expansion. It will be appreciated that each of the positions of the fan section 22, compressor section 24, combustor section 26, turbine section 28, and fan drive gear system 48 may be varied. For example, geared architecture 48 may be located aft of the combustor section 26 or even aft of the turbine section 28, and the fan section 22 may be positioned forward or aft of the location of geared architecture 48.

The gas turbine engine 20 in one example is a high-bypass geared aircraft engine. In a further example, the gas turbine engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the gas turbine engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the gas turbine engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

As will be described below, ceramic core setters with an insert for adjustment of uneven core distortion are provided. The ceramic core setters are divided into multiple pieces and connected by expansion material or a material with a coefficient of thermal expansion (CTE) that is chosen specifically for the geometry in question. In this manner, a setter might be designed to expand or contract (depending on how the expansion material is connected) to better match an expected distortion of the ceramic core due to thermal differences within the core. Rollers or other elements could be provided to allow for setter movement. An additional option would be to produce the top and/or bottom portions of the upper and lower setters from materials with different CTEs.

Figure 2:
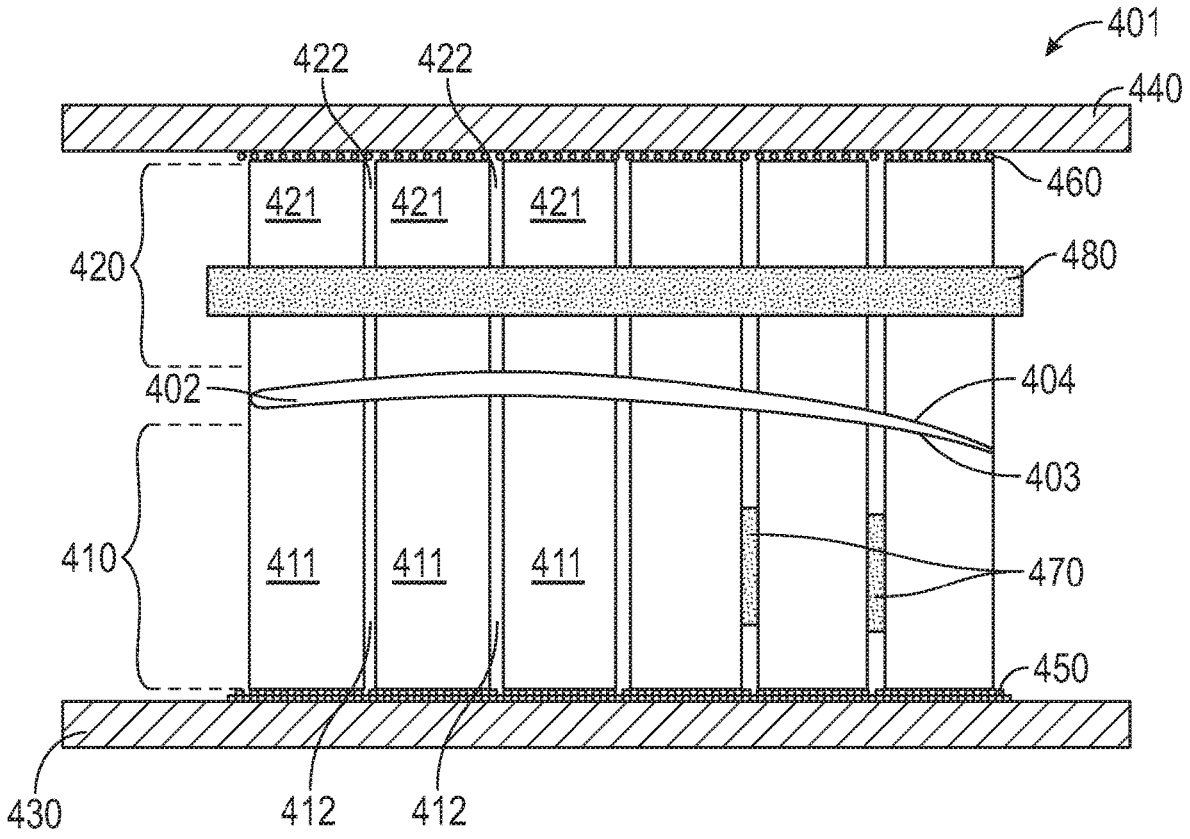
FIG. 2 is a side view of a die setter apparatus in accordance with embodiments.

With reference to FIG. 2, a die setting apparatus 401 is provided for use with a ceramic core 402. In accordance with embodiments, the ceramic core 402 can be provided to form a component of an aerodynamic element of a gas turbine engine (i.e., to form internal passages of an airfoil), such as the gas turbine engine 20 described above. In accordance with further embodiments, the ceramic core 402 can be provided to form internal passages of a turbine airfoil or blade and has a first side 403 and a second side 404. The first side 403 extends radially from root to tip and axially from a leading edge to a trailing edge and is provided proximate to a pressure side. The second side 404 extends radially from the root to the tip and axially from the leading edge to the trailing edge and is provided proximate to a suction side.

The following description will relate to the case of the ceramic core 402 having the first side 403 and the second side 404. This is done for purposes of clarity and brevity and is not intended to otherwise limit a scope of the description or the following claims.

The die setting apparatus 401 is used to secure the ceramic core 402 during thermal processing (e.g., low temperature binder removal, high temperature sintering processes and other firing processes which will be generally referred to hereinbelow as "firing processes"). Typically, the ceramic core 402 will shrink as a result of the firing processes by which binder removal occurs and by which particle consolidation and fusion also occur. The rate of shrinkage can be a function of surface area to volume. Thus, the thicker regions in and around the leading edge will shrink at a different rate than those with thinner cross-sections in and around the trailing edge. The die setting apparatus 401 is configured to accommodate the shrinkage as described below although it is to be understood that, while the following description refers to the shrinkage of the core 402 (i.e., as thermal contraction), the following description also refers to expansion of the core 402 (i.e., as thermal expansion). That is, the die setting apparatus 401 can be responsive to both a shrinking/contraction and an expansion of the core 402 during the firing processes.

The die setting apparatus 401 includes a first setter 410, which is abuttable with the first side 403, and a second setter 420, which is abuttable with the second side 404. At least one of the first setter 410 and the second setter 420 includes two, three, four or however many pieces due to the varying core thicknesses and that are respectively arranged to form one or more gaps. Each of the one or more gaps is oriented to thermally adjust, thermally expand or thermally contract in respective correspondence with thermal changes, thermal expansions or thermal contractions of the ceramic core 402 during a firing process thereof.

In accordance with embodiments, the first setter 410 and the second setter 420 can each include one or more of various materials such as, but not limited to, alumina-based and silica-based materials.

The following description will relate to the case of the first setter 410 including two or more first setter pieces 411 that are respectively arranged to form one or more first gaps 412 and the second setter 420 including two or more second setter pieces 421 that are respectively arranged to form one or more second gaps 422. Here, a number of the two or more first setter pieces 411 differs from or is equal to a number of the two or more second setter pieces 421 and each of the one or more first gaps 412 and each of the one or more second gaps 422 is oriented to thermally adjust, thermally expand or thermally contract in respective correspondence with the thermal changes, the thermal expansions or the thermal contractions of the ceramic core 402 during the firing process thereof. This is done for purposes of clarity and brevity and is not intended to otherwise limit a scope of the description or the following claims.

The die setting apparatus 401 further includes a first jig 430, a second jig 440, first bearing elements 450 respectively interposed between the first jig 430 and the two or more first setter pieces 411 of the first setter 410 and second bearing elements 460 respectively interposed between the second jig 440 and the two or more second setter pieces 421 of the second setter 420. The first bearing elements 450 can be provided as rollers or ball bearings and serve to support and facilitate relative, multi-directional movement of the two or more first setter pieces 411 relative to the first jig 430 during the thermal expansion or contraction of the one or more first gaps 412. The second bearing elements 460 can be provided as rollers or ball bearings and serve to support and facilitate relative, multi-directional movement of the two or more second setter pieces 421 relative to the second jig 440 during the thermal expansion or contraction of the one or more second gaps 422.

In accordance with further embodiments, the die setting apparatus 401 can further include one or more thermal expansion material 470 and thermal contraction material 480. Where provided, the thermal expansion material 470 has a CTE that is matched to that of the ceramic core 402 and is disposable within one or more of the one or more first and second gaps 412 and 422 to drive a thermal expansion thereof. Similarly, where provided, the thermal contraction material 480 has a CTE that is matched to that of the ceramic core 402 and is disposable at an exterior of the one or more of the one or more first and second gaps 412 and 422 to drive a thermal contraction thereof.

Figure 3:
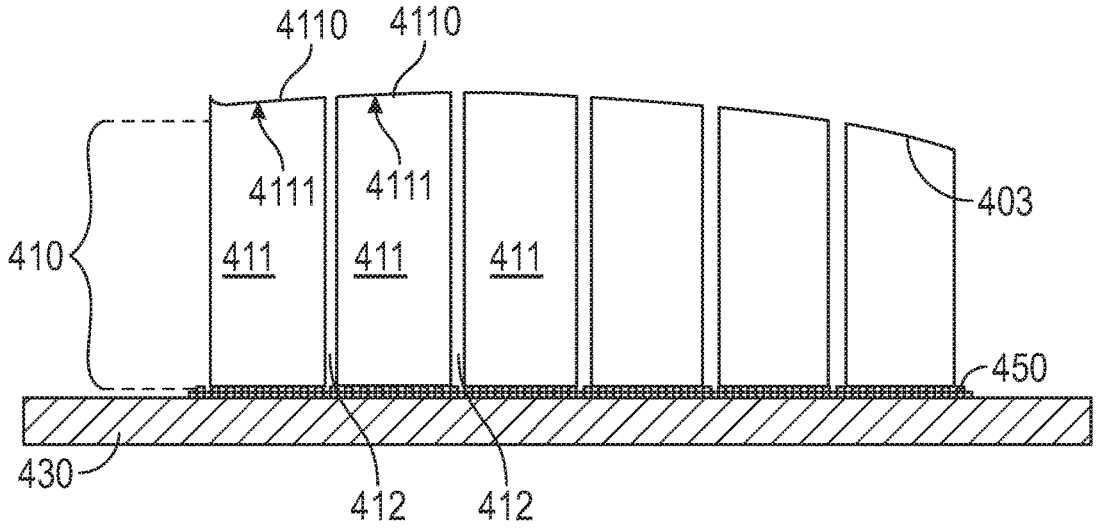
FIG. 3 is a side view of a lower setter of the die setter apparatus of FIG. 2.
Figure 4:
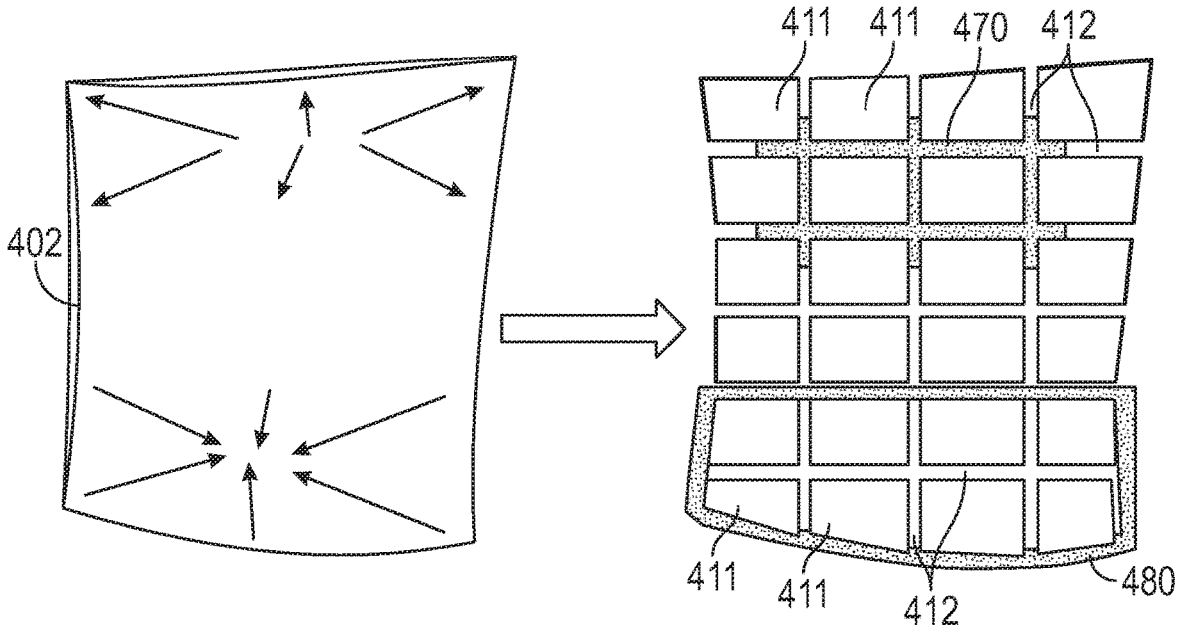
FIG. 4 is a top-down illustration of an arrangement of die setter pieces of the lower setter of FIG. 3.

With continued reference to FIG. 2 and with additional reference to FIGS. 3 and 4, the first setter pieces 411 of the first setter 410 respectively include first setter piece surfaces 4110. Each of the first setter piece surfaces 4110 is respectively abutable with a corresponding portion of a substantial entirety of the first side 403. The first setter piece surfaces 4110 have first piece-wise curvatures 4111. Each of the first piece-wise curvatures 4111 respectively complement corresponding curvatures of various parts of the first side 403.

As shown in FIG. 4, the ceramic core 402 has a shape that is known to thermally contract near the root and to thermally expand near the tip. As such, thermal contraction material 480 is disposed around the first setter pieces 411 of the first setter 410 that abut with the root and thermal expansion material 470 is disposed between the first setter pieces 411 of the first setter 410 that abut with the tip. Thus, during the firing of the ceramic core 402 in this case, as the ceramic core 402 thermally contracts near the root, the first gaps 412 between the first setter pieces 411 that abut with the root will be driven to contract by the thermal contraction material 480 and the corresponding first setter pieces 411 will therefore remain in abutment with the root. Similarly, as the ceramic core 402 thermally expands near the tip, the first gaps 412 between the first setter pieces 411 that abut with the tip will be driven to expand by the thermal expansion material 470 and the corresponding first setter pieces 411 will therefore remain in abutment with the tip.

Figure 5:
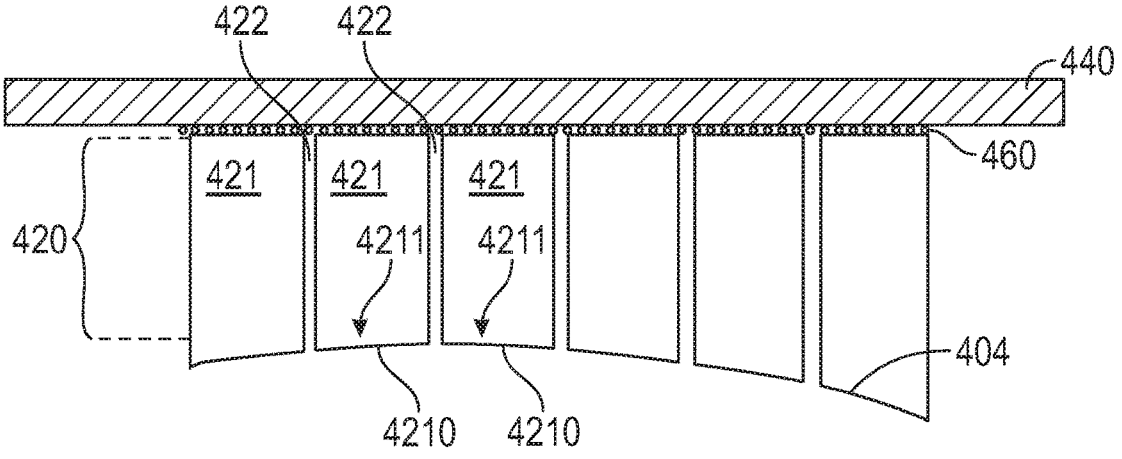
FIG. 5 is a side view of an upper setter of the die setter apparatus of FIG. 2.
Figure 6:
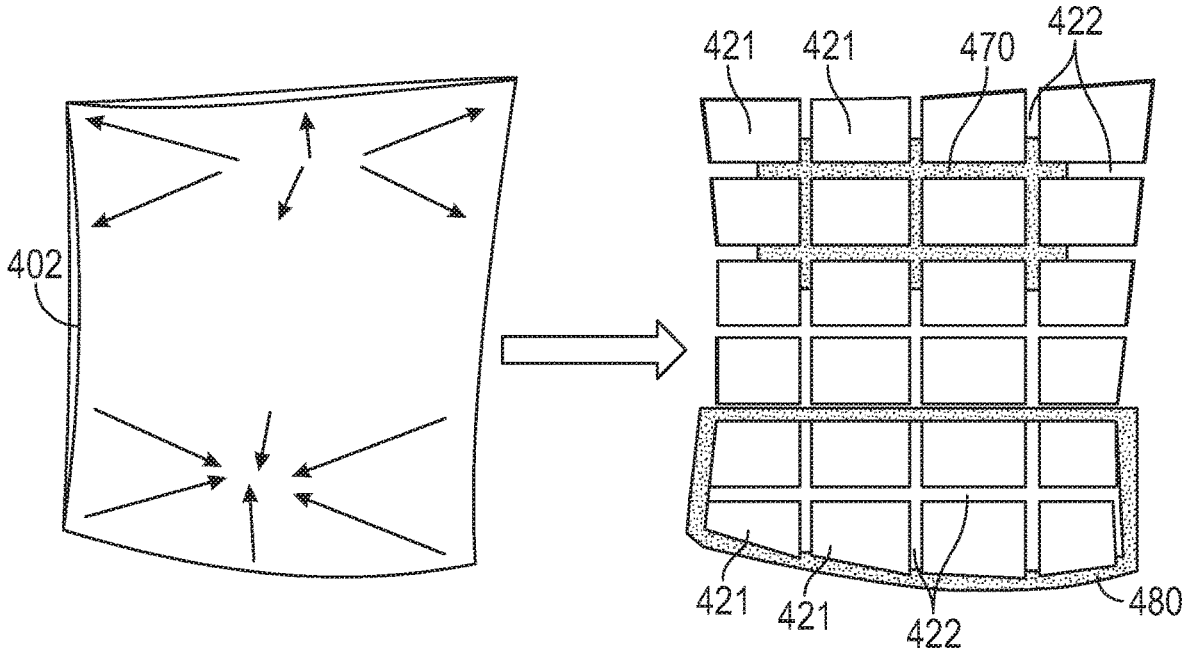
FIG. 6 is a top-down illustration of an arrangement of die setter pieces of the upper setter of FIG. 5.

With continued reference to FIG. 2 and with additional reference to FIGS. 5 and 6, the second setter pieces 421 of the second setter 420 respectively include second setter piece surfaces 4210. Each of the second setter piece surfaces 4210 is respectively abutable with a corresponding portion of a substantial entirety of the second side 404. The second setter piece surfaces 4210 have second piece-wise curvatures 4211. Each of the second piece-wise curvatures 4211 respectively complement corresponding curvatures of various parts of the second side 404.

It is to be understood that the number of the first setter pieces 411 and the number of the second setter pieces 421 can be the same or different.

As shown in FIG. 6, the ceramic core 402 has a shape that is known to thermally contract near the root and to thermally expand near the tip. As such, thermal contraction material 480 is disposed around the second setter pieces 421 of the second setter 420 that abut with the root and thermal expansion material 470 is disposed between the second setter pieces 421 of the second setter 420 that abut with the tip. Thus, during the firing of the ceramic core 402 in this case, as the ceramic core 402 thermally contracts near the root, the second gaps 422 between the second setter pieces 421 that abut with the root will be driven to contract by the thermal contraction material 480 and the corresponding second setter pieces 421 will therefore remain in abutment with the root. Similarly, as the ceramic core 402 thermally expands near the tip, the second gaps 422 between the second setter pieces 421 that abut with the tip will be driven to expand by the thermal expansion material 470 and the corresponding second setter pieces 421 will therefore remain in abutment with the tip.

Figure 7:
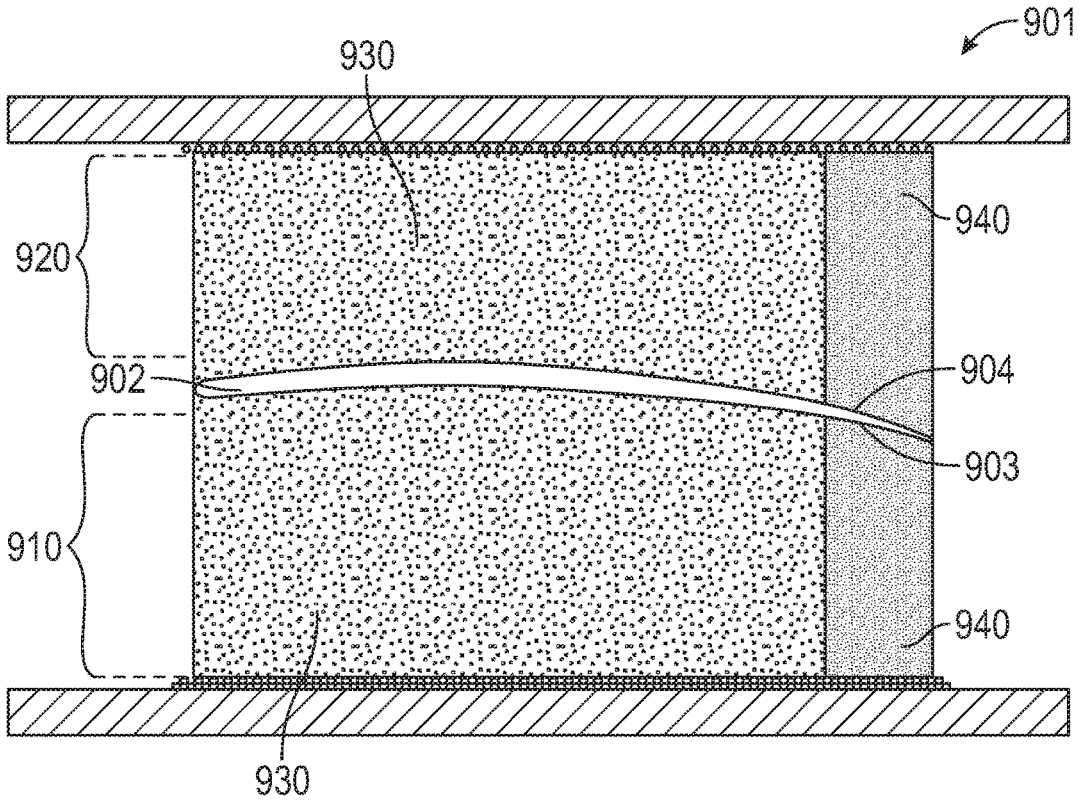
FIG. 7 is a side view of a die setter apparatus in accordance with further embodiments.

With reference to FIG. 7, a die setting apparatus 901 is provided for use with a ceramic core 902. In accordance with embodiments, the ceramic core 902 can be provided as an aerodynamic element of a gas turbine engine, such as the gas turbine engine 20 described above. In accordance with further embodiments, the aerodynamic element can be provided as a turbine blade with a first side 903 and a second side 904. The first side 903 extends radially from root to tip and axially from a leading edge to a trailing edge and is provided as a pressure side. The second side 903 extends radially from the root to the tip and axially from the leading edge to the trailing edge and is provided as a suction side.

The following description will relate to the case of the ceramic core 902 having the first side 903 and the second side 904. This is done for purposes of clarity and brevity and is not intended to otherwise limit a scope of the description or the following claims.

The die setting apparatus 901 includes a first setter 910, which is abuttable with the first side 903, and a second setter 920, which is abuttable with the second side 904. At least one of the first setter 910 and the second setter 920 includes first setter material 930 having a CTE differing from that of the ceramic core 902 and second setter material 940 having a CTE matched to that of the ceramic core 902. In accordance with embodiments, the second setter material 940 can be localized (i.e., localized to those regions of the ceramic core 902 that are most prone to thermal expansion or contraction). In accordance with further embodiments, the second setter material 940 is separate from or integral with the first setter material 930.

It is to be understood that the embodiments described above with reference to FIGS. 2-6 and the embodiments described above with reference to FIG. 7 can be used interchangeably with one another. For example, a portion of the first setter pieces 411 in the first setter 410 can be formed of the first setter material 930 and another portion of the first setter pieces 411 in the first setter 410 can be formed of the second setter material 940. Similarly, a portion of the second setter pieces 421 in the second setter 420 can be formed of the first setter material 930 and another portion of the second setter pieces 421 in the second setter 420 can be formed of the second setter material 940.

Benefits of the features described herein are an allowance for production of relatively long, high taper ceramic cores with cross-sections that vary greatly.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A die setting apparatus for a ceramic core, the die setting apparatus comprising:

a first setter abuttable with a first side of the ceramic core; and a second setter abuttable with a second side of the ceramic core opposite the first side, at least one of the first and second setters comprising two or more pieces respectively arranged to form one or more gaps, and each of the one or more gaps being oriented to thermally adjust in correspondence with thermal changes of the ceramic core during a firing process thereof, wherein:

the die setting apparatus further comprises a thermal expansion material disposable to drive a thermal expansion of one or more of the one or more gaps and a thermal contraction material disposable to drive a thermal contraction of one or more of the one or more gaps, and the thermal expansion material is disposable within the one or more of the one or more gaps and the thermal contraction material is disposable at an exterior of the one or more of the one or more gaps.

2. The die setting apparatus according to claim 1, wherein:

the ceramic core is provided to form a component of an aerodynamic element, the first and second setters comprise first and second surfaces, respectively, which are respectively abutable with respective substantial entireties of the first and second sides of the ceramic core, and the first and second surfaces have first and second curvatures which are respectively complementary to corresponding curvatures of the first and second sides of the ceramic core.

3. The die setting apparatus according to claim 1, further comprising:

a jig; and bearing elements respectively interposed between the jig and the two or more pieces of the at least one of the first and second setters.

4. The die setting apparatus according to claim 1, further comprising at least one of:

a thermal expansion material disposable to drive a thermal expansion of one or more of the one or more gaps; and a thermal contraction material disposable to drive a thermal contraction of one or more of the one or more gaps.

5. The die setting apparatus according to claim 1, wherein the at least one of the thermal expansion material and the thermal contraction material has a coefficient of thermal expansion (CTE) matched to that of the ceramic core.

6. The die setting apparatus according to claim 1, wherein:

the first setter comprises two or more first setter pieces respectively arranged to form one or more first gaps, the second setter comprises two or more second setter pieces respectively arranged to form one or more second gaps, and each of the one or more first and second gaps is oriented to thermally adjust in correspondence with the thermal changes of the ceramic core during the firing process thereof.

7. The die setting apparatus according to claim 6, wherein a number of the two or more first setter pieces differs from a number of the two or more second setter pieces.

8. The die setting apparatus according to claim 1, wherein at least one of the first and second setters comprises:

first setter material having a coefficient of thermal expansion (CTE) differing from that of the ceramic core; and second setter material having a CTE matched to that of the ceramic core.

9. The die setting apparatus according to claim 8, wherein the second setter material is localized.

10. The die setting apparatus according to claim 8, wherein the second setter material is integral with the first setter material.

11. A die setting apparatus for a ceramic core, the die setting apparatus comprising:

a first setter abuttable with a first side of the ceramic core and comprising two or more first setter pieces respectively arranged to form one or more first gaps; and a second setter abuttable with a second side of the ceramic core opposite the first side and comprising two or more second setter pieces respectively arranged to form one or more second gaps, each of the one or more first and second gaps is oriented to thermally expand or contract in correspondence with the thermal expansion or contraction of the ceramic core during a firing process thereof, and the die setting apparatus further comprising at least one of thermal expansion and contraction material disposable to drive a thermal expansion or contraction of one or more of the one or more first and second gaps, wherein the thermal expansion material is disposable within the one or more of the one or more first and second gaps and the thermal contraction material is disposable at an exterior of the one or more of the one or more first and second gaps.

12. The die setting apparatus according to claim 11, wherein:

the ceramic core is provided to form a component of an aerodynamic element, the first setter pieces of the first setter respectively comprise first setter piece surfaces which are respectively abutable with corresponding portions of a substantial entirety of the first side, the second setter pieces of the second setter respectively comprise second setter piece surfaces which are respectively abutable with corresponding portions of a substantial entirety of the second side, and the first and second setter piece surfaces have first and second piece-wise curvatures which are respectively complementary to corresponding curvatures of the first and second sides.

13. The die setting apparatus according to claim 11, further comprising:

first and second jigs;

first bearing elements respectively interposed between the first jig and the two or more first setter pieces of the first setter, and second bearing elements respectively interposed between the second jig and the two or more second setter pieces of the second setter.

14. The die setting apparatus according to claim 11, wherein the at least one of the thermal expansion and contraction material has a coefficient of thermal expansion (CTE) matched to that of the ceramic core.

15. The die setting apparatus according to claim 11, wherein a number of the two or more first setter pieces differs from a number of the two or more second setter pieces.

16. A die setting apparatus for a ceramic core, the die setting apparatus comprising:

a first setter abuttable with a first side of the ceramic core; and a second setter abuttable with a second side of the ceramic core opposite the first side, at least one of the first and second setters comprising first setter material having a coefficient of thermal expansion (CTE) differing from that of the ceramic core and second setter material having a CTE matched to that of the ceramic core, wherein a side of a first portion of the second setter material integrally abuts with a corresponding side of a corresponding first portion of the first setter material at the first side of the ceramic core and a side of a second portion of the second setter material integrally abuts with a corresponding side of a corresponding second portion of the first setter material at the second side of the ceramic core.

17. The die setting apparatus according to claim 16, wherein the second setter material is localized.

* * * * *